US009203149B2

(12) United States Patent
Henderson et al.

(10) Patent No.: US 9,203,149 B2
(45) Date of Patent: Dec. 1, 2015

(54) ANTENNA SYSTEM

(75) Inventors: Robert Ian Henderson, Chelmsford (GB); Christopher Ralph Pescod, Chelmsford (GB); Shahbaz Nawaz, Chelmsford (GB)

(73) Assignee: BAE SYSTEMS plc, London (GB)

( * ) Notice: Subject to any disclaimer, the term of this patent is extended or adjusted under 35 U.S.C. 154(b) by 261 days.

(21) Appl. No.: 13/579,203

(22) PCT Filed: Feb. 9, 2011

(86) PCT No.: PCT/GB2011/050216

§ 371 (c)(1),
(2), (4) Date: Aug. 15, 2012

(87) PCT Pub. No.: WO2011/098792

PCT Pub. Date: Aug. 18, 2011

(65) Prior Publication Data

US 2012/0306708 A1 Dec. 6, 2012

(30) Foreign Application Priority Data

Feb. 15, 2010 (EP) ..... 10275017
Feb. 15, 2010 (GB) ..... 1002438.8

(51) Int. Cl.
*H01Q 19/06* (2006.01)
*H01Q 3/30* (2006.01)
(Continued)

(52) U.S. Cl.
CPC ..... *H01Q 3/30* (2013.01); *H01Q 15/08* (2013.01); *H01Q 19/062* (2013.01); *H01Q 21/065* (2013.01)

(58) Field of Classification Search
CPC ..... H01Q 21/00; H01Q 19/062; H01Q 3/00; H01Q 15/02; H01Q 19/06; H01Q 15/08; H01Q 19/08; H01Q 3/46
USPC ..... 343/753, 754, 755
See application file for complete search history.

(56) References Cited

U.S. PATENT DOCUMENTS 2,795,783 A * 6/1957 Dunbar ..... 343/754
3,146,451 A 8/1964 Sternberg
(Continued)

FOREIGN PATENT DOCUMENTS

EP 0 773 598 A2 5/1997
EP 1 085 599 A2 3/2001
(Continued)

OTHER PUBLICATIONS

International Preliminary Report on Patentability and Written Opinion, dated Aug. 30, 2012 from related International Application No. PCT/GB2011/050216.
(Continued)

*Primary Examiner* — Dameon E Levi
*Assistant Examiner* — Collin Dawkins
(74) *Attorney, Agent, or Firm* — Scully, Scott, Murphy & Presser, PC

(57) ABSTRACT

An antenna system, comprising: a phased array antenna (4); and a dielectric lens arrangement (6), for example a single solid dielectric lens (6) comprising a substantially spherical convex surface (12) and a concave surface (14); wherein the dielectric lens arrangement (6) is arranged to magnify the effective aperture of the phased array antenna (4). The concave surface (14) is positioned within the near field of the phased array antenna (4). The phased array antenna (4) is operated at a frequency greater than or equal to 50 GHz. The antenna system retains some ability to electronically scan the beam. The antenna system may be for transmission and/or reception. The antenna system may be used for example for communication between two vehicles.

22 Claims, 3 Drawing Sheets

(51) Int. Cl.
*H01Q 15/08* (2006.01)
*H01Q 21/06* (2006.01)

(56) References Cited

U.S. PATENT DOCUMENTS

| | | | | |
|---|---|---|---|---|
| 4,458,249 | A | 7/1984 | Valentino et al. | |
| 6,052,087 | A * | 4/2000 | Ishikawa et al. | 343/700 MS |
| 7,672,270 | B2 * | 3/2010 | Roggero et al. | 370/328 |
| 2002/0036587 | A1 | 3/2002 | Martin et al. | |
| 2005/0062660 | A1 * | 3/2005 | Henderson et al. | 343/754 |
| 2005/0128144 | A1 | 6/2005 | Himmelstoss et al. | |
| 2007/0268198 | A1 * | 11/2007 | Marshall et al. | 343/911 R |
| 2008/0278393 | A1 * | 11/2008 | Gottwald et al. | 343/753 |
| 2009/0021436 | A1 * | 1/2009 | Clymer et al. | 343/713 |
| 2009/0315794 | A1 * | 12/2009 | Alamouti et al. | 343/753 |
| 2011/0018784 | A1 * | 1/2011 | Hilsebecher et al. | 343/893 |

FOREIGN PATENT DOCUMENTS

| | | | | |
|---|---|---|---|---|
| GB | 1 403 769 | | 8/1975 | |
| GB | 2 189 650 | A | 10/1987 | |
| JP | 2001-127537 | A | 5/2001 | |
| WO | WO 2005/107181 | A1 | 11/2005 | |
| WO | WO 2007/136289 | A1 | 11/2007 | |
| WO | WO 2009080387 | A1 * | 7/2009 | H01Q 19/06 |

OTHER PUBLICATIONS

Costa, Jorge R., "Evaluation of a Double-Shell Integrated Scanning Lens Antenna", IEEE Antennas and Wireless Propagation Letters (2008), vol. 7, pp. 781-784.

Ap Rhys, T.L., "The Homogeneous Sphere as a Millimeter-Wave Lens", Fourth International Antennas and Propagation Symposium (1966), IEEE, New York, pp. 59-66.

International Search Report dated Apr. 8, 2011 issued in PCT/GB2011/050216.

Extended European Search Report dated May 17, 2010 issued in 10275017.1.

UK Search Report dated May 26, 2010 issued in GB1002438.8.

* cited by examiner

ANTENNA SYSTEM

FIELD OF THE INVENTION

The present invention relates to wireless antenna systems and arrangements, in particular systems and arrangements including one or more phased array antennas.

BACKGROUND

Phased array antennas are well known, and are used for example to provide wireless links. One or more phased array antennas may provide transmission and one or more phased array antennas may provide reception.

Signal processing arrangements for modulating and otherwise providing suitable transmission signals, and for receiving and demodulating received signals, are also well known.

Phased array antennas and signal processing arrangements are provided in many variations for many different uses. In many applications, frequencies of less than 10 GHz are employed, requiring relatively large antenna sizes. For a given phased array antenna, there will be limitations on its useful range (i.e. distance between transmitter and receiver) of operation. Conventionally, to increase range, antenna size and/or power must be increased.

SUMMARY OF THE INVENTION

The present inventors have realised it would be desirable to provide an antenna system or arrangement that gives a required range of operation by a solution other than that of increasing antenna size and/or power. The present inventors have realised this would be particularly desirable in a context of achieving ranges of, say, 100 m, with small equipment sizes, as such a solution could efficiently be deployed in applications where larger equipment would be less suitable, for example as a wireless communication system between vehicles, e.g. between vehicles.

In a first aspect, the present invention provides an antenna system, comprising: a phased array antenna; and a dielectric lens arrangement; wherein the dielectric lens arrangement is arranged to magnify the effective aperture of the phased array antenna.

The dielectric lens arrangement may be a single solid dielectric lens.

The solid dielectric lens may comprise a convex surface and a concave surface.

The convex surface may be substantially spherical.

The side of the dielectric lens arrangement closest to the phased array antenna may be positioned within the near field of the phased array antenna.

The phased array antenna may be adapted to be operated at a frequency greater than or equal to 50 GHz.

The dielectric lens may be of a material having a dielectric constant greater than or equal to 2.

The dielectric lens may be of a material having a dielectric constant greater than or equal to 5.

The antenna system may be arranged such that the antenna system retains some ability to electronically scan the beam provided by and/or being received by the antenna system.

The antenna system may be adapted to be used as a transmission antenna system.

The antenna system may be adapted to be used as a reception antenna system.

In a further aspect, the present invention provides a wireless communication system comprising, as a transmission antenna system, at least one antenna system according to any of the above aspects.

In a further aspect, the present invention provides a wireless communication system comprising, as a reception antenna system, at least one antenna system according to any of the above aspects.

In a further aspect, the present invention provides a wireless communication system comprising, as a transmission antenna system, at least one antenna system according to any of the above aspects, and further comprising, as a reception antenna system, at least one antenna system according to any of the above aspects.

In a further aspect, the present invention provides a use of one or more antenna systems according to any of claims 1 to 9 for communication between two vehicles.

DETAILED DESCRIPTION

Figure 1:
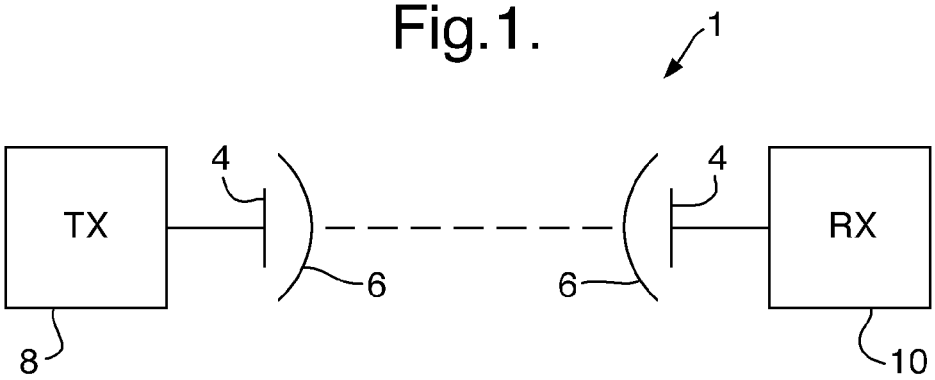
FIG. 1 is a schematic illustration (not to scale) of a wireless system.

FIG. 1 is a schematic illustration (not to scale) of a first embodiment of a wireless system 1. The wireless system 1 comprises two antenna systems 2, which in this embodiment are the same as each other. Each antenna system 2 comprises a phased array antenna 4 and a dielectric lens 6. The phased array antenna 4 is placed in front of, and spaced apart, from the dielectric lens 6.

The phased array antenna 4 of a first of the antenna systems 2 (which may be termed the transmission antenna system) is electrically coupled to a transmission module 8. The phased array antenna 4 of the other of the antenna systems 2 (which may be termed the reception antenna system) is electrically coupled to a reception module 10.

The phased array antennas 4 are placed close to the respective dielectric lenses 6 so that in operation, in the case of transmission, millimeter waves emitted from the phased array antenna 4 pass through the dielectric lens 6 before continuing onwards away from the phased array antenna, and in the case of reception, external millimeter waves falling on the dielectric lens 6 pass through the dielectric lens 6 before continuing on to fall on the phased array antenna 4.

The transmission antenna system is positioned remote from the reception antenna system. For example, the transmission antenna system may advantageously be placed on a first vehicle, and the reception antenna system may be placed on a second vehicle. In operation, when the transmission antenna system and the reception antenna system are sufficiently aligned, i.e. in effect sufficiently pointed at each other (within angular ranges that will be described in more detail later below), signals generated/modulated by the transmission module 8 are transmitted from the transmission antenna system 2, received by the reception antenna system, and demodulated/otherwise processed by the reception module 10.

In other embodiments, only one of the antenna systems, e.g. either the transmission antenna system or the reception antenna system, is as described above, and the other antenna system is a conventional antenna system comprising a phased array antenna but without a dielectric lens.

In yet further embodiments, either one, or both, of the above described antenna systems are coupled to both a transmission module and a reception module, and may individually be used for transmission and/or reception, as opposed to only transmission or only reception.

In yet further embodiments, any of the above described arrangements are modified by using plural antenna systems for either or both of the functions of transmission and reception.

It will also be appreciated that, as well as the overall wireless system 1 being an embodiment of the invention, paired arrangements of one or more transmission antenna systems with one or more reception antenna systems also represent embodiments of the present invention; and moreover, a single antenna system 2 (i.e. a phased array antenna with a dielectric lens 2), with a transmission and/or reception module represents an embodiment of the present invention; and also a single antenna system 2 (i.e. a phased array antenna with a dielectric lens 2), without a transmission and/or reception module represents in itself an embodiment of the present invention.

Figure 2:
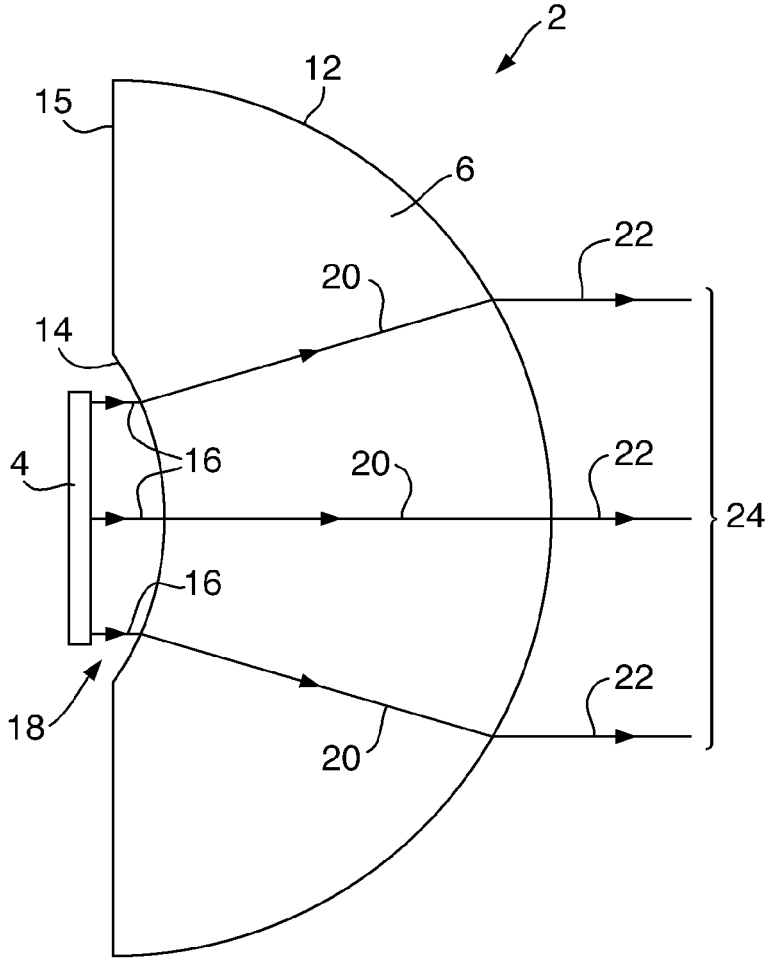
FIG. 2 is a schematic illustration (not to scale) showing an antenna system of the wireless system of FIG. 1.

FIG. 2 is a schematic illustration (not to scale) showing the antenna system 2, comprising the phased array antenna 4 and the dielectric lens 6, in further detail. In this embodiment, the dielectric lens 6 is a solid spherical lens, comprising a convex curved outer surface 12 and a concave curved inner surface 14, where the curved outer surface 12 is the surface further away from the phased array antenna 4 and the curved inner surface 14 is the surface closer to the phased array antenna 4. The curved outer surface 12 is larger than the curved inner surface 14. As a consequence, a further extent of surface exists between the curved inner surface 14 and the curved outer surface 12, which for convenience will be termed the remaining inner surface 15.

In overview, in operation, the dielectric lens 6 effectively acts as a magnifying lens, in the standard way for such a lens, as follows. (For convenience, certain optical terminology is used in the following summary of the effect of the lens, and likewise for convenience certain properties of the millimeter waves employed are simplified or schematised to allow the effect of the lens to be most readily appreciated.) The operation will be described in terms of transmission. It will be appreciated that the reverse operations occur in the case of reception. In operation, the phased array antenna 4 emits electromagnetic waves (in this embodiment millimeter waves) 16 that initially, in the so-called near field, may be considered as being nominally parallel to each other, i.e. providing a nominally parallel beam 18. The curved inner surface 14 of the dielectric lens 6 is positioned relative to the phased array antenna 4 such that the distance there between is smaller than the extent of the near-field, i.e. smaller than the Rayleigh distance. Thus the nominally parallel rays 16 of the nominally parallel beam 18 reach the curved inner surface 14 where they are diverged to provide diverged rays 20. The diverged rays 20 then pass through the dielectric lens 6 to reach the outer curved surface 12, where they are converged to be parallel to each other again and thereby provide a nominally parallel beam 24 exiting the dielectric lens 6 at the curved outer surface 12. The nominally parallel beam 24 is magnified compared to the original nominally parallel beam 18 that was emitted by the phased array antenna 4 and passed into the dielectric lens 6 through the inner curved surface 14, and hence is hereinafter referred to as the magnified nominally parallel beam 24. In other words, the dielectric lens 6 has in effect magnified the effective radiating aperture of the phased array antenna 4 (in the case of reception the dielectric lens 6 in effect magnifies the effective reception aperture of the phased array antenna 4).

Figure 3:
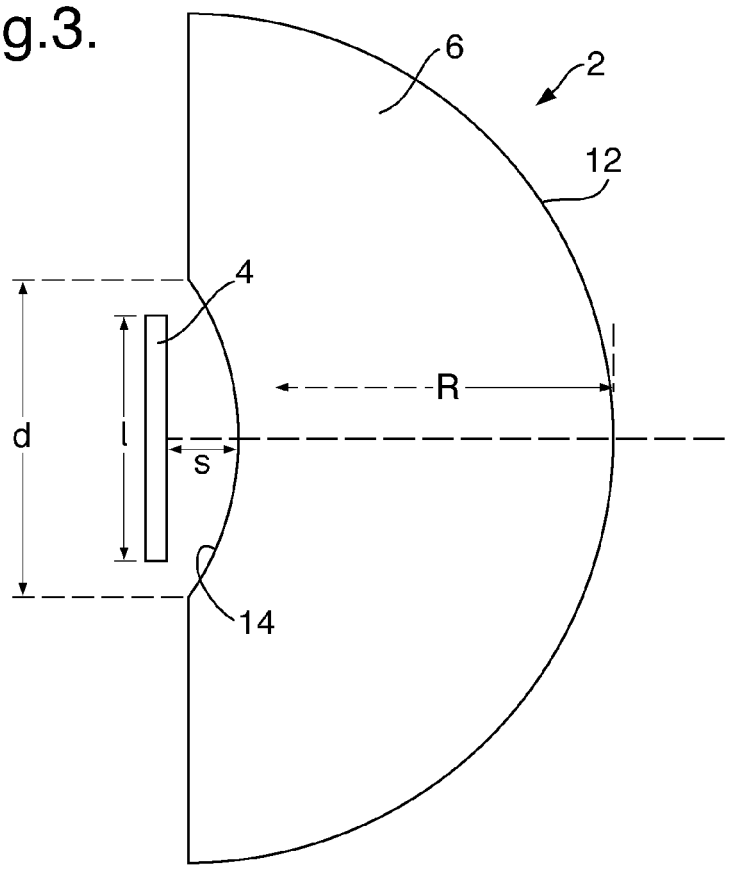
FIG. 3 is a schematic illustration (not to scale) showing certain dimensional details of the antenna system of FIG. 2.

FIG. 3 is a schematic illustration (not to scale) showing certain dimensional details of the antenna system 2.

In this embodiment, the curved outer surface is substantially a spherical shaped surface, with a radius R of approximately 0.035 m (35 mm). The centre of the emission surface of the phased array antenna is approximately placed at the centre of the sphere defining the spherical shaping of the outer curved surface 12.

In this embodiment, the inner curved surface 14 is substantially elliptical shaped with a focal point behind the phased array antenna. More details of the functional effect of this will be described later below with reference to FIG. 4. In this embodiment, the focal point is at a distance of approximately 17 mm.

In this embodiment, the separation s between the centre of the radiating surface of the phased array antenna and the axially aligned point (i.e. closest point or central point) on the inner curved surface 14 of the dielectric lens 6 is approximately 0.005 m (5 mm).

In this embodiment, the phased array antenna 4 is approximately square shaped, with sides of length l approximately equal to 0.015 m (15 mm).

In this embodiment, the dielectric lens is made of solid nylon, with a dielectric constant $\in_r$ approximately equal to 3. However, in other embodiments, other materials with other dielectric constant values may be used. Preferably a dielectric constant equal to or greater than 2 is used. For example, PTFE with dielectric constant of approximately 2 may be used. Also for example, in other embodiments a material called "Eccostock" (trademark) HIK 500F, available from Emerson & Cuming Microwave Products N.V., Nijverheidsstraat 7A, B-2260 Westerlo, Belgium, is used. In this embodiment, this material has a dielectric constant of approximately 5. The effect of different dielectric constant values of the material of the dielectric lens 6 will be discussed later below. Other examples of materials with dielectric constant of approximately $\in_r$=5, and which advantageously have relatively low loss at 60 GHz, are boron nitride and a material called "Macor" (trademark) available from Corning Incorporated Lighting & Materials, Houghton Park CB-08, Corning, N.Y. 14831.

In other embodiments, other types of lens arrangements (for example multi-lens telescope arrangements such as a Keplerian refractor or a Galilean telescope arrangement) may be used instead of the above described dielectric lens of this embodiment. However, compared to other such possibilities, the use in this embodiment of the dielectric lens 6 described above, i.e. a single solid lens of a relatively high dielectric material and with a shape based on a spherical surface, advantageously provides a reasonable amount of gain i.e. magnification, whilst only requiring a relatively small physical size.

Figure 4:
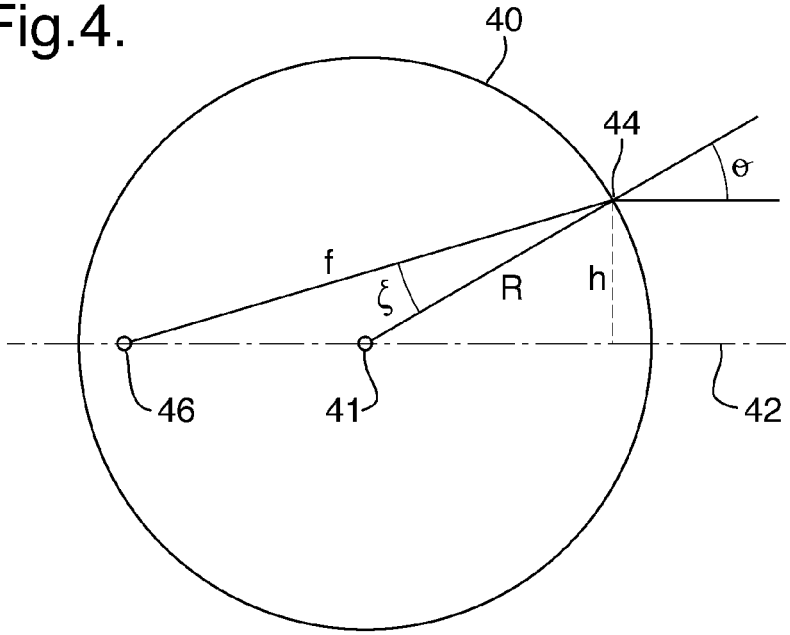
FIG. 4 is a diagram illustrating aspects of refraction by a spherical lens.

The operation of the antenna system 2 of this embodiment, and in particular the operation of the dielectric lens 6, can further be understood by considering FIG. 4, which is a diagram illustrating aspects of refraction by a spherical lens. FIG. 4 shows a theoretical spherical lens surface (indicated in FIG. 4 by reference numeral 40) of radius R with a centre point indicated in FIG. 4 by reference numeral 41, considered in terms of a reference diameter direction (indicated in FIG. 4 by reference numeral 42). For any given point (indicated in FIG. 4 by reference numeral 44) on the spherical lens surface 40, a height from that point to the reference diameter 42 is termed h; for a ray originating from the centre of the sphere 41 and falling on the surface point 44, the angle between the original direction of that ray and the output (refracted) ray is termed θ; the distance between the focal point of the lens (indicated in FIG. 4 by reference numeral 46) and the surface point 44, i.e. the focal length, is termed f; and the angle between the line from the focal point 46 to the surface point 44 and the radius to the surface point 44 is termed ξ.

A spherical lens of constant dielectric constant brings a bundle of incident rays to an approximate focus. The location of the focal point for paraxial rays depends only on the dielectric constant of the sphere (see FIG. 4). Using the small angle approximation, the focal length f is given in terms of the radius of the sphere R by $$f = \frac{R\sqrt{\varepsilon}}{\sqrt{\varepsilon} - 1}.$$

When, for example, the dielectric constant is ∈=4, the focus lies on the circumference. As the dielectric constant is increased, the focus approaches but never reaches the centre of the sphere.

By virtue of the phased array antenna 4 being positioned behind the concave curved inner surface 14 at the centre of the sphere, the operation is similar to that of a Galilean telescope, i.e. the rays are approximately directed as illustrated in, and described above with reference to, FIG. 2.

The concave curved inner surface 14 is preferably designed to convert the cone of rays from the convex outer surface 12 to a parallel bundle. The magnification m available for such an arrangement is $$m = \frac{f}{f - R} = \sqrt{\varepsilon}$$

and therefore depends only on the dielectric constant. For example, (as per one preferred embodiment) a magnification of 2.236 is achieved by the use of the above mentioned material with a dielectric constant equal to 5. By providing a magnification of 2.236 (in both azimuth and elevation), the useful range of the antenna system 2 is, to a first approximation, increased by a factor of $2.236^2$ i.e. approximately 5. Thus, in approximate terms, although using a phased array antenna with a useful range of approximately 20 m (as is the case for the phased array antenna 4 of this embodiment, which will be described in more detail later below with reference to FIG. 6), the overall antenna system 2 provides a useful range of approximately 100 m. (Note each lens increases the effective aperture in both azimuth and elevation dimensions.)

In other embodiments, the radius R of the lens can be freely chosen within reason, but preferably it should be larger than the magnified image of the array. However, if it is too small, diffraction may dominate.

By using a spherical shape for the convex outer curved surface 12 of the dielectric lens 6, distortion or deviation arising from the different swept angles involved in the operation of the phased array antenna 4 is reduced or avoided. However, in other embodiments, this advantage may be traded off with improved gain at specific angles by using shapes other than spherical, for example by using elliptical or hyperbolic shaped surfaces. It will also be appreciated that the whole of the outer surface need not be fully in compliance with the basic operational shape of the surface. For example, the surface may be truncated with a cylinder shape at the rear to aid mounting of the lens. Also for example, grooves or notches or ridges (in addition to the grooves to be described later below with reference to FIG. 5) may be included for the purposes of fixing the dielectric lens mechanically to clamps or the like. Depending on their positions or size, such variations may degrade performance but only to a limited extent compared to the overall magnification and uniformity achieved by the lens, or may, if located sufficiently radially distant from the magnified image of the antenna, have no, or at least negligible, interplay with the magnification process.

By using an elliptical shape for the concave inner curved surface 14, "optical" performance tends to be optimised. However, since a shallow curvature is preferable, the exact details of the curved surface shape are not very significant, i.e. in other embodiments other shapes may be used for the concave curved inner surface.

Figure 5:
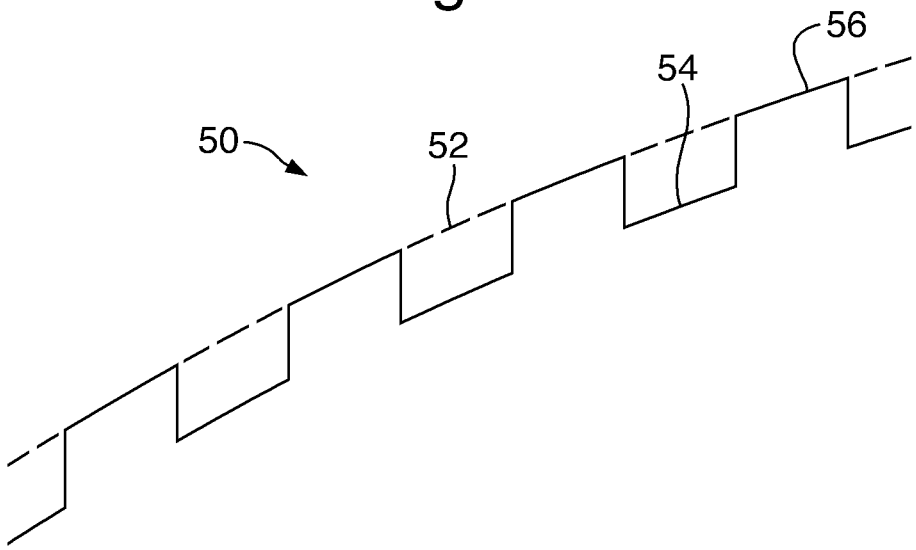
FIG. 5 is a schematic illustration (not to scale) of grooves which are provided at both surfaces of a dielectric lens forming part of the antenna system of FIG. 2.

In this embodiment the inner curved surface 14 and the outer curved surface 12 are both provided with (i.e. the surfaces comprise a further detail of shaping) with concentric grooves for the purpose of providing, at least to some extent, impedance matching, i.e. the grooves function as an anti-reflection measure. The grooves represent a way of minimising the mismatch between the high dielectric constant of the lens and that of free space. FIG. 5 is a schematic illustration (not to scale) of the grooves which are provided at both surfaces. The dotted line indicated by reference numeral 52 represents a hypothetical smooth form of the respective curved surfaces. The grooves 50 are provided by virtue of troughs 54 and ridges 56. The grooves are preferably at less than half-wavelength pitch, which in the case of operation at 60 GHz means a pitch of 2.5 mm or less is desirable. In this embodiment, a pitch of 1.5 mm is provided, with the ridges 56 and the troughs 54 each being 0.75 mm wide. The height or depth of the grooves is 0.85 mm. The optimum values depend upon the intended frequency to be used.

In other embodiments, anti-reflection properties may instead be provided by the use of antireflection coatings applied to the curved surfaces, or by any other appropriate means.

In the above described embodiments, the shape of the dielectric lens 6 may be provided by any suitable manufacturing process, for example by machining a solid block of the material or by casting.

Figure 6:
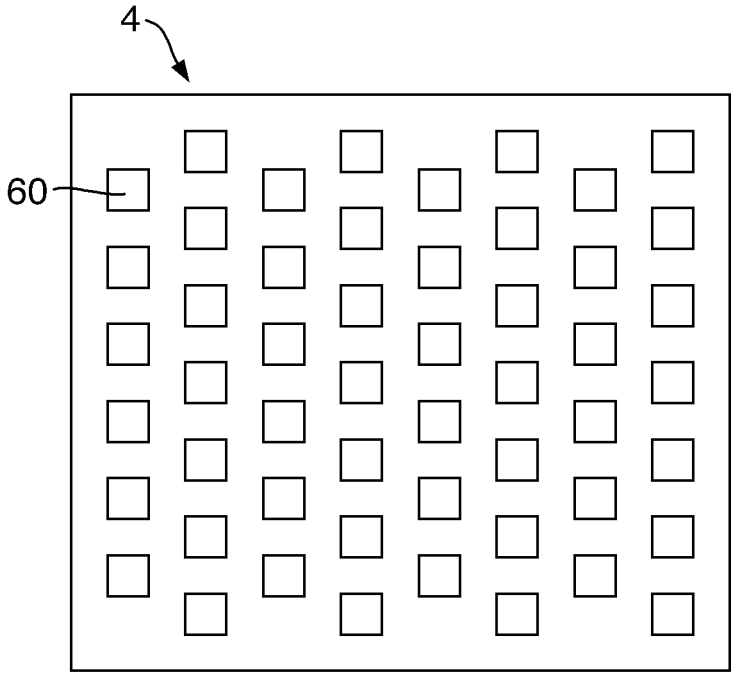
FIG. 6 is a schematic illustration (not to scale) of a phased array antenna 4 forming part of the antenna system of FIG. 2.

Further details of the phased array antenna 4 of this embodiment will now be described. FIG. 6 is a schematic illustration (not to scale) of the phased array antenna 4. In this embodiment the phased array antenna 4 comprises a total of fifty-two dipole-like antenna elements 60 arranged in eight alternating columns of six and seven elements. The overall size of the antenna is approximately 0.015 m×0.015 m (15 mm×15 mm). The phased array antennas 4 of this embodiment provide thirty-six beams with wide elevation and azimuth scan angular ranges to allow for non line of sight operation. These are commercial units sold by AboCom Systems Inc. (trademark) of No. 77, Yu-Yih Road, Chu-Nan Chen, Miao-Lih Hsuan, Taiwan, R.O.C. that are provided for the WirelessHD standard market (i.e. digital video data).

In this embodiment the phased array antenna is operated in the frequency range of 57 to 66 GHz.

Beam-forming electronics are used to drive the array to produce a fixed set of beams using phase shifters. These may be positioned directly behind the radiating array, or may be provided in a separate module, for example being provided as part of the transmission module 8. (In the case of reception, the corresponding electronics serves to perform the receive signal amplification and beamforming function). This reception electronics may be positioned directly behind the radiating array, or may be provided in a separate module, for example being provided as part of the reception module 10.)

In this embodiment, as mentioned above, the phased array antenna 4 operating on its own, i.e. without the dielectric lens 6, can generate a beam that covers a wide azimuth and elevation scan angular range. The angular range of the antenna system 2, i.e. the effect of the dielectric lens 6, is that the angular output range is reduced. In this embodiment, the reduction in angular range is related to the reduction in the beamwidth. In general the improvement in distance range is at a cost of angular range. However, there are many applications where such a trade-off is either irrelevant or at least bearable, for example in a vehicle to vehicle communications application as mentioned earlier. Also, in some applications the relative positioning and directionality between the transmission antenna system and the reception antenna system can be fixed, in which case relatively narrow angular range can be tolerated (and may even be advantageous). In yet further embodiments, the achievable azimuth angle can be traded off with the achievable elevation angle, for example by use of asymmetrical lens shapes.

It will be appreciated that an advantage of the above described embodiments is that increased distance range is achieved whilst retaining at least a significant extent of the ability to electronically scan the beam.

In the above described embodiments the phased array antenna is operated at a frequency between 57 to 66 GHz. By using such a relatively high frequency, the physical size of the dielectric lens can be kept small. Thus, in preferred embodiments, the phased array antenna is operated at frequencies greater than or equal to 50 GHz. However, in other embodiments other frequencies may be used.

In the above described embodiments the phased array antenna is as described with reference to FIG. 6. However, this need not be the case, and in other embodiments other implementations or details of phased array antenna may be used instead, for example different sizes, different angular output, different numbers of antenna elements, different numbers of beams, different beam properties, and so on.

Likewise, some or all of the various dimensions of the various elements employed in the above described embodiments, e.g. sizes of the dielectric lens and the phased array antenna, and spacing between the various elements employed in the above described embodiments, may be different in other embodiments.

The invention claimed is:

1. An antenna system, comprising:

a phased array antenna for emitting electromagnetic waves as a first nominally parallel beam at a first effective aperture; and a dielectric lens arrangement spaced apart from the phased array antenna;

wherein the dielectric lens arrangement comprises a curved inner surface positioned within the near field of the phased array antenna thereby defining the first effective aperture, the curved inner surface diverging the first nominally parallel beam to provide diverged rays diverged relative to the first nominally parallel beam and a curved outer surface for converging the diverged rays relative to the diverged rays to provide a second nominally parallel beam, thereby defining a second effective aperture larger than the first effective aperture of the phased array antenna.

2. An antenna system according to claim 1, wherein the dielectric lens arrangement is a single solid dielectric lens.

3. An antenna system according to claim 2, wherein the curved outer surface is convex and the curved inner surface is concave.

4. An antenna system according to claim 3, wherein the convex curved outer surface is substantially spherical.

5. An antenna system according to claim 4, wherein an emission surface of the phased array antenna is positioned substantially at the centre of a sphere defined by the substantially spherical outer curved.

6. An antenna system according to claim 3, wherein the concave curved inner surface is configured to convert a cone of rays from the convex curved outer surface to the nominally parallel beam.

7. An antenna system according to claim 2, wherein the dielectric lens is of a material having a dielectric constant greater than or equal to 2.

8. An antenna system according to claim 7, wherein the dielectric lens is of a material having a dielectric constant greater than or equal to 5.

9. An antenna system as in claim 2 wherein the curved outer surface of the dielectric lens is provided with troughs and ridges, for minimising the mismatch between the high dielectric constant of the lens and that of free space.

10. An antenna system as in claim 9 wherein the troughs and ridges are arranged to form concentric grooves.

11. An antenna system as in claim 9 wherein the curved inner surface of the dielectric lens is provided with troughs and ridges, for minimising the mismatch between the high dielectric constant of the lens and that of free space.

12. An antenna system according to claim 1, wherein the phased array antenna is adapted to be operated at a frequency greater than or equal to 50 GHz.

13. An antenna system according to claim 1 arranged such that the antenna system retains some ability to electronically scan the beam provided by and/or being received by the antenna system.

14. An antenna system as in claim 1, wherein the lens increases the effective aperture in both azimuth and elevation dimensions.

15. An antenna system according to claim 1, wherein the curved outer surface is larger than the curved inner surface and the dielectric lens arrangement includes a further surface between the curved inner surface and the curved outer surface.

16. An antenna system according to claim 1, wherein the inner curved surface is substantially elliptical shaped with a focal point behind the phased array antenna.

17. An antenna system comprising:

a phased array antenna for emitting electromagnetic waves as a first nominally parallel beam at a first effective aperture; and a dielectric lens arrangement spaced apart from the phased array antenna;

wherein the dielectric lens arrangement comprises a curved inner surface positioned within the near field of the phased array antenna thereby defining the first effective aperture, the curved inner surface diverging the first nominally parallel beam to provide diverged rays diverged relative to the first nominally parallel beam and a curved outer surface for converging the diverged rays relative to the diverged rays to provide a second nominally parallel beam, thereby defining a second effective aperture larger than the first effective aperture of the phased array antenna, the antenna system being adapted to be used as a transmission antenna system.

18. An antenna system comprising:

a phased array antenna for emitting electromagnetic waves as a first nominally parallel beam at a first effective aperture; and a dielectric lens arrangement spaced apart from the phased array antenna;

wherein the dielectric lens arrangement comprises a curved inner surface positioned within the near field of the phased array antenna thereby defining the first effective aperture, the curved inner surface diverging the first nominally parallel beam to provide diverged rays diverged relative to the first nominally parallel beam and a curved outer surface for converging the diverged rays relative to the diverged rays to provide a second nominally parallel beam, thereby defining a second effective aperture larger than the first effective aperture of the phased array antenna, the antenna system being adapted to be used as a reception antenna system.

19. A wireless communication system comprising, as a transmission antenna system, at least one antenna system comprising:

a phased array antenna for emitting electromagnetic waves as a first nominally parallel beam at a first effective aperture; and a dielectric lens arrangement spaced apart from the phased array antenna;

wherein the dielectric lens arrangement comprises a curved inner surface positioned within the near field of the phased array antenna thereby defining the first effective aperture, the curved inner surface diverging the first nominally parallel beam to provide diverged rays diverged relative to the first nominally parallel beam and a curved outer surface for converging the diverged rays relative to the diverged rays to provide a second nominally parallel beam, thereby defining a second effective aperture larger than the first effective aperture of the phased array antenna.

20. A wireless communication system comprising, as a reception antenna system, at least one antenna system comprising:

a phased array antenna for receiving electromagnetic waves as a first nominally parallel beam at a first effective aperture; and a dielectric lens arrangement spaced apart from the phased array antenna;

wherein the dielectric lens arrangement comprises a curved outer surface and a curved inner surface positioned within the near field of the phased array antenna, the curved outer surface converging the first nominally parallel beam to provide converging rays converged relative to the first nominally parallel beam, the curved inner surface for diverging the converging rays relative to the converging rays to provide a second nominally parallel beam, thereby defining a second effective aperture smaller than the first effective aperture of the phased array antenna.

21. A wireless communication system comprising, as a transmission antenna system, at least one antenna system comprising:

a first phased array antenna for emitting electromagnetic waves as a first nominally parallel beam at an effective aperture; and a first dielectric lens arrangement spaced apart from the phased array antenna;

wherein the first dielectric lens arrangement comprises a curved inner surface positioned within the near field of the phased array antenna thereby defining the first effective aperture, the curved inner surface diverging the first nominally parallel beam to provide diverged rays diverged relative to the first nominally parallel beam and a curved outer surface for converging the diverged rays relative to the diverged rays to provide a second nominally parallel beam, thereby defining a second effective aperture larger than the first effective aperture of the first phased array antenna, and further comprising, as a reception antenna system, at least one antenna system comprising:

a second phased array antenna for receiving electromagnetic waves as the second nominally parallel beam at the second effective aperture; and a second dielectric lens arrangement;

wherein the second dielectric lens arrangement comprises a curved outer surface and a curved inner surface positioned within the near field of the phased array antenna, the curved inner surface converging the second nominally parallel to provide converging rays converged relative to the second nominally parallel beam, the curved inner surface diverging the converging rays relative to the converging rays to provide a third nominally parallel beam, thereby defining a third effective aperture of the second phased array antenna smaller than the second effective aperture.

22. A system for communication between two vehicles, the system comprising one or more antenna systems comprising:

a phased array antenna for emitting electromagnetic waves as a first nominally parallel beam at an effective aperture; and a dielectric lens arrangement spaced apart from the phased array antenna;

wherein the dielectric lens arrangement comprises a curved inner surface positioned within the near field of the phased array antenna thereby defining the first effective aperture, the curved inner surface diverging the first nominally parallel beam to provide diverged rays diverged relative to the first nominally parallel beam and a curved outer surface for converging the diverged rays relative to the diverged rays to provide a second nominally parallel beam, thereby defining a second effective aperture larger than the first effective aperture of the phased array antenna.

* * * * *